US009538890B2

(12) United States Patent
Wang

(10) Patent No.: US 9,538,890 B2
(45) Date of Patent: Jan. 10, 2017

(54) VERTICAL VACUUM CLEANER

(75) Inventor: Shoumu Wang, Suzhou (CN)

(73) Assignee: ECOVACS ROBOTICS CO., LTD., Suzhou (CN)

( * ) Notice: Subject to any disclaimer, the term of this patent is extended or adjusted under 35 U.S.C. 154(b) by 227 days.

(21) Appl. No.: 14/239,423

(22) PCT Filed: Aug. 6, 2012

(86) PCT No.: PCT/CN2012/079712
§ 371 (c)(1),
(2), (4) Date: Apr. 4, 2014

(87) PCT Pub. No.: WO2013/026353
PCT Pub. Date: Feb. 28, 2013

(65) Prior Publication Data

US 2015/0089768 A1 Apr. 2, 2015

(30) Foreign Application Priority Data

Aug. 19, 2011 (CN) ..... 2011 1 0239987

(51) Int. Cl.
*A47L 5/30* (2006.01)
*A47L 5/32* (2006.01)
*A47L 5/22* (2006.01)

(52) U.S. Cl.
CPC ..... *A47L 5/30* (2013.01); *A47L 5/225* (2013.01); *A47L 5/32* (2013.01)

(58) Field of Classification Search
CPC ..... A47L 9/1683; A47L 9/02; A47L 9/106; A47L 5/30; A47L 5/32; A47L 5/225
See application file for complete search history.

(56) References Cited

U.S. PATENT DOCUMENTS 6,079,077 A * 6/2000 Kajihara ..... A47L 9/242 15/331
6,317,921 B1 11/2001 Park et al.
(Continued)

FOREIGN PATENT DOCUMENTS

CN 1572205 A 2/2005
CN 101073481 A 11/2007
(Continued)

OTHER PUBLICATIONS

Search Report PCT/CN2012/079712, date of mailing Nov. 22, 2012, 5 pages.
(Continued)

*Primary Examiner* — Robert Scruggs
(74) *Attorney, Agent, or Firm* — Nixon Peabody LLP

(57) ABSTRACT

The present invention discloses an upright vacuum cleaner which comprises a cleaner body (100), a ground brush (200), a dust collection chamber (300), a conversion valve and a pipeline system. The conversion valve (400) is disposed at the outside of the back surface of the cleaner body (100) and is located at an inward recess between the dust collection chamber (300) and the ground brush (200). The conversion valve (400) is provided with a first air inlet, a second air inlet and an air outlet of the conversion valve. The pipeline system comprises a suction soft pipe (501), an air duct (203) of the floor brush, a machine body air inlet duct (503), a machine body air outlet duct (504) and a motor chamber exhaust pipe. The pipeline system further comprises a motor chamber air inlet pipe (505) of which one end is connected with the air duct (203) of the ground brush, and the other end is connected with the first air inlet (505) of the conversion valve after passing through the motor chamber and being bend upward against the outside of the back surface of the floor brush. The upright vacuum cleaner can clean not only the floor but also other places above the floor. The upright
(Continued)

vacuum cleaner provides an unblocked air flow, has a compact structure, saves spaces, is convenient to package, and is not easily damaged.

14 Claims, 9 Drawing Sheets

(56) References Cited

U.S. PATENT DOCUMENTS

| | | | | |
|---|---|---|---|---|
| 7,805,807 | B2 * | 10/2010 | Blocker | A47L 5/30 15/331 |
| 2015/0089768 | A1 * | 4/2015 | Wang | A47L 5/225 15/347 |

FOREIGN PATENT DOCUMENTS

| | | | |
|---|---|---|---|
| CN | 101201123 | A | 6/2008 |
| CN | 202231560 | U | 5/2012 |
| GB | 2309157 | A | 7/1997 |
| GB | 2325399 | A | 11/1998 |

OTHER PUBLICATIONS

Written Opinion PCT/CN2012/079712, dated of mailing Nov. 22, 2012, 6 pages.

* cited by examiner

VERTICAL VACUUM CLEANER

FIELD OF THE INVENTION

The present invention relates to a vacuum cleaner, in particular an upright vacuum cleaner.

BACKGROUND OF THE PRIOR ART

The conventional upright vacuum cleaner comprises a cleaner body (also known as cleaner casing or upright body), a ground brush (also generally named as suction nozzle), a dust collection chamber and a pipeline system (also known as air duct system). The ground brush is positioned at the lower part of the cleaner body and is provided with an air inlet and a motor chamber. The dust collection chamber is positioned above the ground brush and is provided with an air inlet and an air outlet. The pipeline system comprises: an air duct of the ground brush connected with the air inlet of the ground brush; a machine body air inlet duct connecting the air duct of the ground brush to the air inlet of the dust collection chamber; a machine body air outlet duct connecting the air outlet of the dust collection chamber to the motor chamber, and an exhaust pipe of the motor chamber.

In general, the conventional upright vacuum cleaner is suitable for cleaning the indoor open ground, but encounters difficulties in playing its effective role on the other positions such as hidden corners, steps and table tops. The reasons are that the dust enters the cleaner casing from the air inlet of the ground brush which is close to the ground. Except for by the air inlet of the ground brush close to the ground, the conventional upright vacuum cleaner has no other means to absorb dust.

In recent years, in order that the upright vacuum cleaner is capable of cleaning either the indoor open ground or other positions such as hidden corners, the improvements on the conventional upright vacuum cleaners are proposed, and the major improvement is the addition of a conversion valve and a suction soft pipe on the basis of conventional upright vacuum cleaner. For example, a Chinese patent CN 200410002222.3 and its patent family U.S. Pat. No. 7,213,297B2 propose such an upright vacuum cleaner with a suction soft pipe and a conversion valve, and similar products are available in the domestic market. The suction soft pipe is also known as cleaner soft pipe of which one end is connected with one air inlet of the conversion valve and the other end is used as an air suction inlet designed to clean the hidden corners or the other positions on the ground. The conversion valve is also known as pipe switching device which is positioned on the side of the cleaner body and is designed to regulate the connection and disconnection of different pipes, so that the cleaner switches between the operating state for cleaning open ground and the operating state for cleaning other positions.

As to the conversion valve of the upright vacuum cleaner as described above, there are many different structures, however each of them is provided with two air inlets and one air outlet. For the convenience of discrimination, one of the air inlets is named as the first air inlet, and the other air inlet is named as the second air inlet. The first air inlet is connected with the air duct of the ground brush via one air inlet pipe of the conversion valve which is poisoned as a whole on the outside of the ground brush and runs through the casing of the ground brush. The second air inlet is connected with the suction soft pipe. The air outlet of the conversion valve is connected with the air duct of the dust collection chamber via an air outlet pipe of the conversion valve.

When the first air inlet of the conversion valve is communicated with the air outlet of the conversion valve, the second air inlet of the conversion valve is in a closed state. At this time, the air duct of the ground brush, the air inlet pipe of the conversion valve, the air outlet of the conversion valve pipe and the air machine body inlet pipe are in a connected state. To the contrary, when the second air inlet of the conversion valve and the air outlet of the conversion valve are in a connected state, the first air inlet of the conversion valve is in closed state. At this time, the suction soft pipe, the air outlet of the conversion valve pipe and the air machine body inlet pipe are in a connected state.

When the upright vacuum cleaner provided with the conversion valve is used to clean the ground, the conversion valve is regulated firstly, so that the air duct of the ground brush, the air inlet pipe of the conversion valve, the air outlet of the conversion valve pipe and the air machine body inlet pipe are in a connected state. Then, the cleaner is powered on. Under the action of the internal suction of the cleaner, the dust or finely divided sundries adhering to the ground will, together with air, enter the dust collection chamber along the air inlet of the ground brush, the air duct of the ground brush and the air inlet pipe of the conversion valve (which is positioned as a whole on the outside of ground brush; in the specification of the Patent CN 200410002222.3, this pipe is named as "pressure head side suction soft pipe," but is called as "air inlet pipe of the conversion valve" by some market attendants), the air outlet pipe of the conversion valve and the machine body air inlet duct. After being filtered through the filter screen in the dust collection chamber, the air is finally discharged from the cleaner body, while the dust and the finely divided sundries are remained in the dust collection chamber. In this process, the airflow direction in the air duct of the cleaner is shown as follows: air enters the air duct of the ground brush from the air inlet of the ground brush-->the air inlet pipe of the conversion valve (positioned on the outside of ground brush)-->the conversion valve-->the air outlet pipe of the conversion valve-->the air machine body inlet pipe-->the dust collection chamber-->the machine body air outlet duct-->a vacuum chamber-->the motor air exhaust pipe-->an exhaust outlet-->the atmosphere.

When the upright vacuum cleaner provided with the conversion valve is used to clean the other positions such as steps and table top, the conversion valve is regulated firstly, so that the suction soft pipe is communicated with the pipe which has entered the dust separating device, and at the same time, the air inlet of the conversion valve communicated with the air duct of the ground brush is closed. Then the motor is powered on. In the meanwhile, the nozzle of the suction soft pipe is allowed to contact with the position to be cleaned. Under the action of the internal suction of the cleaner, the dust or finely divided sundries adhering to the ground will, together with air, enter the conversion valve along the suction soft pipe, enter the dust-separating device through the air outlet of the conversion valve, and finally are deposited in the dust collecting barrel. In this process, the airflow direction in the air duct of the cleaner is shown as follows: air enters the suction soft pipe-->the conversion valve-->the air outlet pipe of the conversion valve-->the air machine body inlet pipe-->the dust collection chamber-->the machine body air outlet duct-->a motor vacuum chamber-->the motor exhaust pipe-->the exhaust outlet-->the atmosphere.

In a word, the said upright vacuum cleaner provided with suction soft pipe and conversion valve solves the problem of cleaning either the open ground or other positions such as hidden corners, steps and table tops. However, the upright vacuum cleaner with conversion valve in the prior art has deficiencies, in particular the unreasonable arrangement of pipes (air ducts). In other word, in the existing arrangement of air ducts, the airflow enters the air duct of the ground brush from the air inlet of ground brush, and then enters the dust collecting barrel through the air inlet pipe of the conversion valve (soft pipe or rigid pipe) provided on the outside of ground brush and by way of the conversion valve, the air outlet pipe of the conversion valve and the air machine body inlet pipe in turn. Since the soft pipe or hard pipe is provided on the outside of ground brush, such arrangement is not compact in overall structure and thus occupies more space; Furthermore, since the air inlet pipe of the conversion valve is exposed outside as a whole, it may be easily damaged and does not facilitate product packaging; In particular, since the air inlet pipe of the conversion valve is exposed as a whole on the outside of ground brush, the pipe collecting pipe is relatively longer, thus the energy loss of air in the process of flowing in the pipe is increased, leading to inadequate smoothness of air flow.

SUMMARY OF THE INVENTION

The technical object of the present invention is to provide an upright vacuum cleaner being capable of cleaning either open ground or other positions such as hidden corners, steps and table tops and ensures smooth airflow, compact structure, easy packaging and large durability against breakage.

To solve the above problems, the following technical solutions are adopted.

The upright vacuum cleaner comprises a cleaner body, a ground brush, a dust collection chamber, a conversion valve and a pipeline system.

The ground brush is positioned at the lower part of the cleaner body and is provided with an air inlet of the ground brush and a motor chamber.

The dust collection chamber is positioned above the ground brush and is provided with an air inlet and an air outlet;

The conversion valve is provided on the outside of the back surface of the cleaner body, is positioned in an inward recess between the dust collection chamber and the motor chamber, and is provided with a first air inlet, a second air inlet and an air outlet of the conversion valve.

The pipeline system comprises: a suction soft pipe connected with the second air inlet of the conversion valve; an air duct of the ground brush connected with the air inlet of the ground brush; an air outlet pipe of the conversion valve connected with the air outlet of the conversion valve; a machine body air inlet duct connecting the air outlet pipe of the conversion valve with the air inlet of the dust collection chamber; a machine body air outlet duct connecting the air outlet of the dust collection chamber with the motor chamber; and an exhaust pipe of the motor chamber. The pipeline system also comprises an air inlet pipe of the motor chamber, wherein one end of the air inlet pipe of the motor chamber is connected with the air duct of the ground brush, and the other end of the air inlet pipe of the motor chamber is connected with the first air inlet of the conversion valve after passing through the motor chamber and then being bent upwards along the outside of the back surface of ground brush.

The main differences between the upright vacuum cleaner of the present invention and the prior art are listed as below.

First, the air inlet pipe of the conversion valve in the upright vacuum cleaner of the prior art is exposed as a whole on the outside of ground brush. On the other hand, the air inlet pipe (corresponding to the air inlet pipe of the conversion valve in the prior art) of the motor chamber in the upright vacuum cleaner of the present invention is disposed as a whole within the ground brush except for the part adjacent to the joint with the first air inlet of the conversion valve.

Second, the conversion valve of upright vacuum cleaner in the prior art is provided on the side of the cleaner body. On the other hand, the conversion valve of the upright vacuum cleaner according to the present invention is provided on the outside of the back surface of the cleaner body and is positioned in the inward recess between the dust collection chamber and the motor chamber. This arrangement can maximally reduce the portions of the air inlet pipe of the motor chamber and the air outlet pipe of the conversion valve which are exposed on the outside of the cleaner body, hereby allowing the pipeline system in the present invention to have a more compact structure.

Furthermore, since the longer portion of the air inlet pipe of the motor chamber in the present invention is provided within the motor chamber, this pipe in the present invention is named as "air inlet pipe of the motor chamber" for discrimination.

On the basis of the above technical solutions, the present invention further adopts the following technical solutions.

The end part of the suction soft pipe at the joint with the second air inlet of the conversion valve is set as a hard pipe, and both the air inlet pipe of the motor chamber and the air outlet pipe of the conversion valve are hard pipes.

Further, in the pipeline system, all the joints of pipes are designed in an arc shape.

Further, the air inlet pipe of the motor chamber is designed as a soft pipe.

Further, the air inlet pipe of the motor chamber is composed of three parts communicated in turn.

Further, among the three parts constituting the air inlet pipe of the motor chamber, the part directly connected with the first air inlet of the conversion valve is designed as a soft pipe, and the other two pars are set as hard pipes.

Further, the conversion valve comprises a conversion valve body, a conversion valve casing and a conversion valve knob, wherein the conversion valve body is disposed in the conversion valve casing, and the conversion valve body and the conversion valve casing can slide with respect to each other in a rotary manner.

An air inlet of the conversion valve body and an air outlet of the conversion valve body are provided on the conversion valve body, and an arc-shaped air duct 406 of the conversion valve body is provided between the air inlet of the conversion valve body and the air outlet of the conversion valve body.

The conversion valve casing comprises a conversion valve back casing and a conversion valve front seat. An air outlet of the conversion valve casing and first and second air inlets of the conversion valve casing are provided on the conversion valve back casing, wherein the air outlet, the first air inlet and the second air inlet of the conversion valve casing are provided in the same plane, and an angle between every two of them is 120 degrees.

The air inlet and the air outlet of the conversion valve body and the air outlet and the first and second air inlets of the conversion valve casing are also provided in a same plane. The first air inlet of the conversion valve casing and the air inlet of the conversion valve body jointly constitute the first air inlet of the conversion valve. The second air inlet of the conversion valve casing and the air inlet of the conversion valve body jointly constitute the second air inlet of the conversion valve. The air outlet of the conversion valve casing and the air outlet of the conversion valve body jointly constitute the air outlet of the conversion valve.

The conversion valve knob comprises a rotating shaft and a torsion arm, wherein one end of the rotating shaft is connected with the conversion valve casing, and the other end of the rotating shaft is connected with the torsion arm.

The upright vacuum cleaner of the present invention has the following beneficial effects.

1. The upright vacuum cleaner of the present invention is capable of cleaning either open ground or other positions such as hidden corners. Furthermore, it can ensure smooth air flow and thus avoid the pipes from being blocked due to dust accumulation. Such a technical effect is achieved due to the provision of the conversion valve and the suction soft pipe and the provision of the air inlet pipe of the motor chamber as a whole within the motor chamber, hereby reducing the path of air flow circulation and the energy loss in the process of air flow circulation. In particular, when all the joints of pipes are designed in an arc shape, the present invention is even favorable to the circulation of air flow.

2. The following advantages are also brought by the configuration in which the inlet pipe of the motor chamber is provided as a whole within the motor chamber: compact structure, space saving, easy packing, and indestructible.

DETAILED DESCRIPTION OF PREFERRED EMBODIMENTS

Figure 1:
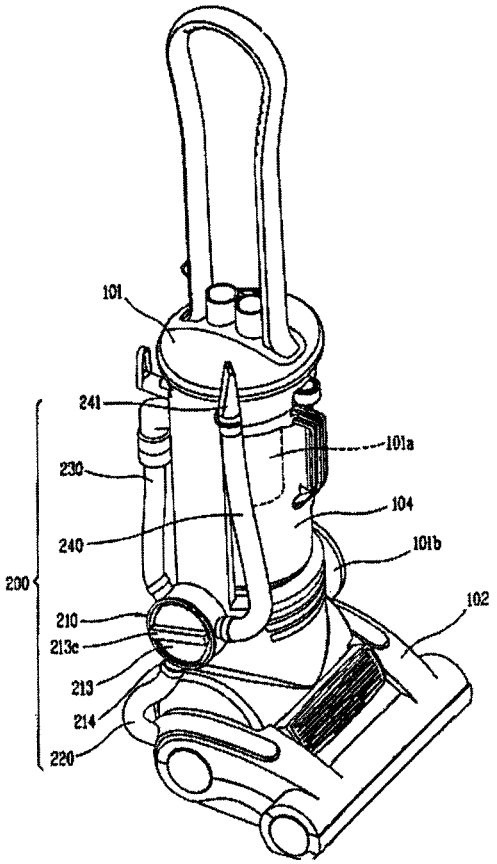
FIG. 1 is a configuration diagram of the existing upright vacuum cleaner.
Figure 2:
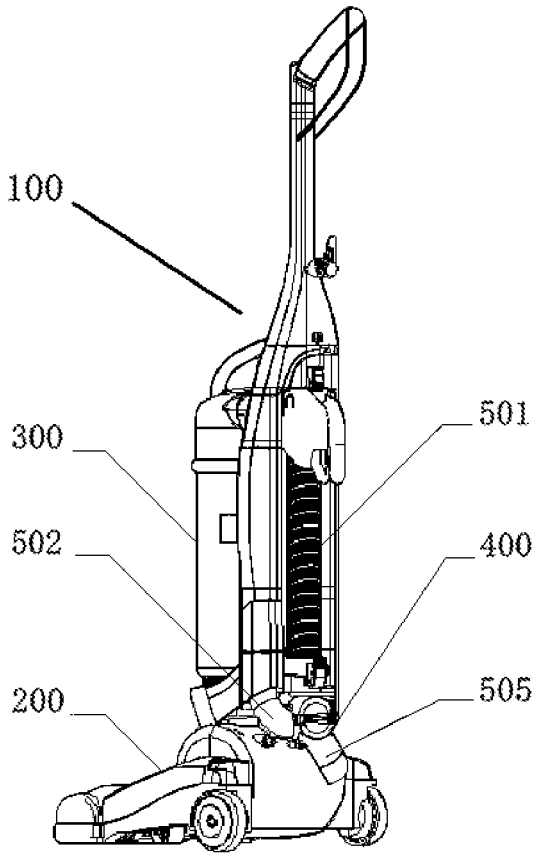
FIG. 2 is a configuration diagram of the body of the cleaner of the present invention.
Figure 3:
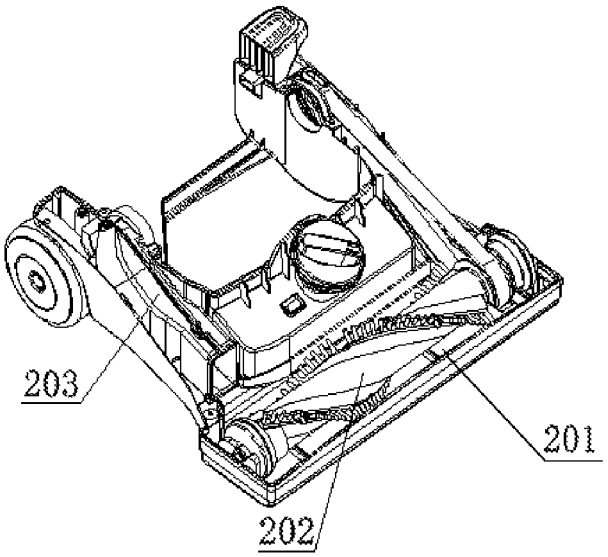
FIG. 3 is a configuration diagram of the floor brush and the floor brush air duct.
Figure 4:
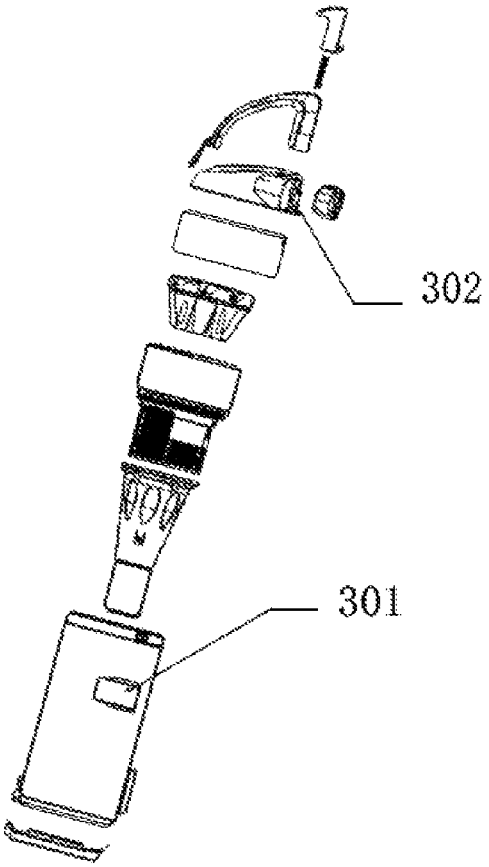
FIG. 4 is an exploded view of the dust collection chamber of the present invention.
Figure 5:
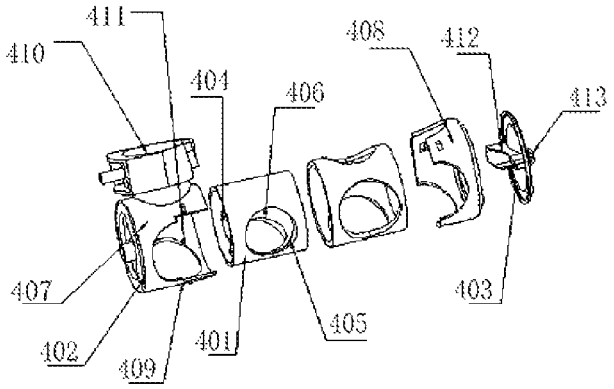
FIG. 5 is an exploded view of the conversion valve of the present invention.
Figure 6:
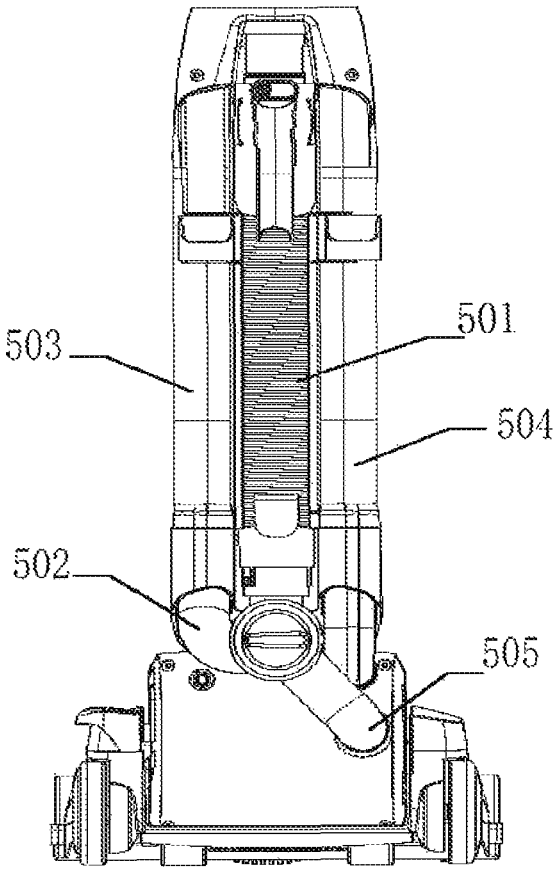
FIG. 6 is a diagram of the pipeline system of the present invention.

Referring to FIGS. 2-6, an upright vacuum cleaner is illustrated, which comprises the following devices and systems.

The upright vacuum cleaner comprises a cleaner body 100, a ground brush 200, a dust collection chamber 300, a conversion valve 400 and a pipeline system.

The ground brush 200 is positioned at the lower part of the cleaner body and is provided with an air inlet of the ground brush 201, a rolling brush 202 and a motor chamber.

The dust collection chamber 300 is positioned above the ground brush 200 and is provided with an air inlet 301 and an exhaust outlet 302.

The conversion valve 400 is provided in the back surface of the cleaner body 100 and is positioned at an inward recess between the ground brush 200 and the dust collection chamber 300, and the conversion valve 400 comprises a conversion valve body 401, a conversion valve casing 402 and a conversion valve knob 403. The conversion valve body 401 is disposed within the conversion valve casing 402, and the conversion valve body 401 and the conversion valve casing 402 can slide with respect to each other in a rotary manner. An air inlet 404 and an air outlet 405 of the conversion valve body are respectively provided on the conversion valve body 401, and an arc-shaped airflow channel 406 of the conversion valve body is provided between the air inlet 404 and the air outlet 405 of the conversion valve body.

The conversion valve casing 402 comprises a conversion valve back casing 407 and a conversion valve front seat 408. An air outlet 409 and first and second air inlets 410, 411 of the conversion valve casing are provided on the conversion valve back casing 407. The casing air outlet 409 and the first and second air inlets 410, 411 of the conversion valve casing are provided in the same plane, and an angle between every two of them is 120 degrees.

The air inlet 404 and the air outlet 405 of the conversion valve body are provided in the same plane as the air outlet 409 and the first and second air inlets 410, 411 of the conversion valve casing. The first air inlet 410 of the conversion valve casing and the air inlet 404 of the conversion valve body jointly constitute the first air inlet of the conversion valve. The second air inlet 411 of the conversion valve casing and the air inlet 404 of the conversion valve body jointly constitute the second air inlet of the conversion valve. The air outlet 409 of the conversion valve casing and the air outlet 405 of the conversion valve body jointly constitute the air outlet of the conversion valve.

The conversion valve knob 403 comprises a rotating shaft 412 and a torsion arm 413, wherein one end of the rotating shaft 412 is connected with the conversion valve casing 402, and the other end of the rotating shaft 412 is connected with the torsion arm 413.

The pipeline system comprises: a suction duct 501 connected with the second air inlet of the conversion valve; an air duct 203 of the ground brush connected with the air inlet 201 of the ground brush; an air outlet pipe 502 of the conversion valve connected with the air outlet of the conversion valve; a machine body air inlet duct 503 connecting the air outlet pipe 502 of the conversion valve with the air inlet 301 of the dust collection chamber; a machine body air outlet duct 504 connecting the air outlet 302 of the dust collection chamber with the motor chamber, and a exhaust pipe of the motor chamber. In a general case, the suction duct 501 connected with the second air inlet of the conversion valve is made of a soft pipe, so as to facilitate stretching and moving. Therefore, the suction duct 510 is customarily named as a suction soft pipe. It is noted that, the suction duct 501 may be made of hard pipe or other pipe.

The pipeline system also comprises an air inlet pipe 505 of the motor chamber, in which air inlet pipe 505 one end is connected with the air duct 203 of the ground brush and the other end is connected with the first air inlet of the conversion valve after passing through the motor chamber and then being bent upwards against the outside of the back surface of the ground brush 200.

In the implementation of the present invention, the air inlet pipe 505 of the motor chamber and the air outlet pipe 502 of the conversion valve are generally designed using hard pipes. The end of the suction soft pipe at the joint with the second air inlet of the conversion valve is designed using a hard pipe. The above pipes or a part thereof are designed using hard pipes, hereby allowing the joints of the pipes to have compact structure and thus saving space.

Further, all the joints of pipes in the pipeline system are designed in an arc shape. Such a design facilitates the smooth circulation of air flow.

Further, the air inlet pipe 505 of the motor chamber is designed as a soft pipe. Such a design facilitates the flexible adjustment of the position of the air inlet pipe of the motor chamber 505.

Further, the air inlet pipe 505 of the motor chamber is designed as a pipe formed by communicating three parts in turn. Such a design realizes a simple manufacturing process and an easy installation.

Furthermore, among the three parts constituting the air inlet pipe 505 of the motor chamber, the part directly connected with the first air inlet 410 of the conversion valve casing is designed as a soft pipe and the other two parts are designed as hard pipes. The former design facilitates installation, and the latter designs realize the compact structure of the pipeline system.

The structural features of the upright vacuum cleaner of the present invention are described hereinbefore with reference to the attached drawings. The basic operation procedures of the upright vacuum cleaner of the present invention are further described with reference to the attached drawings hereinafter.

Figure 7A:
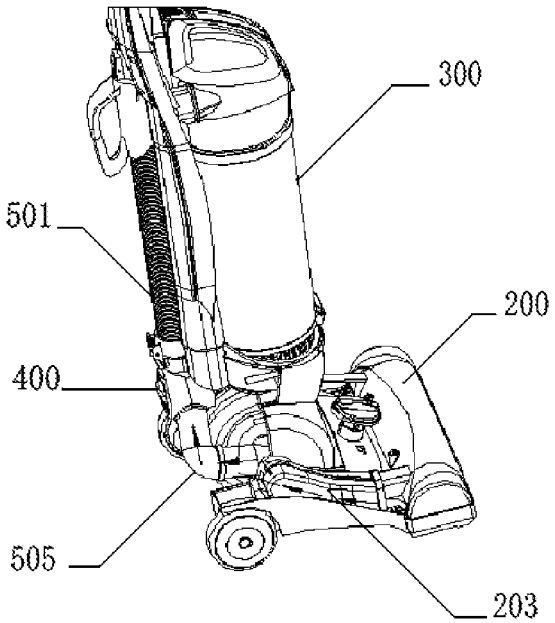
FIGS. 7A and 7B are diagrams illustrating the airflow and the operating state of the conversion valve when the upright vacuum cleaner of the present invention cleans the floor.
Figure 7B:
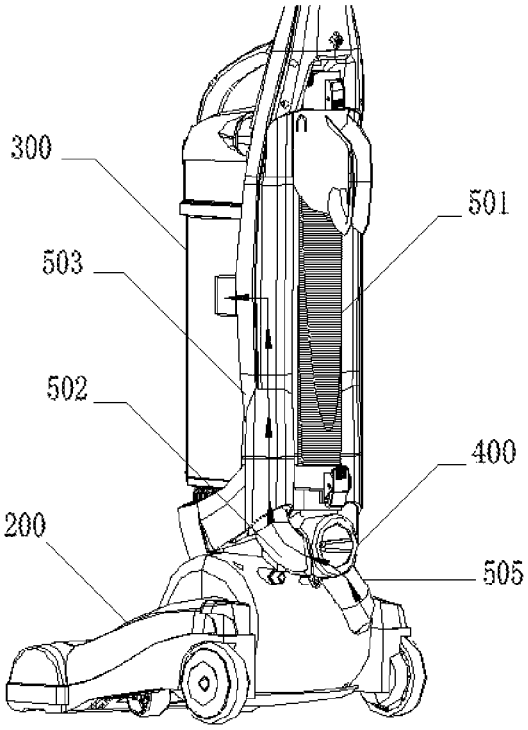

When cleaning the ground by using the upright vacuum cleaner of the present invention, the user should firstly regulate the conversion valve knob 403 to the position as shown in FIG. 7A, so that the first air inlet 410 (which is connected with the air inlet pipe 505 of the motor chamber) of the conversion valve casing is aligned with the air inlet 404 of the conversion valve body, and thus the second air inlet 411 (which is communicated with the suction soft pipe 501) of the conversion valve casing is also closed simultaneously. Then, the motor is powered on. Under the action of the suction force generated by the rotation of the fan driven by the motor, the dust or finely divided sundries adhering to the ground will, together with air, enter the first air inlet 410 of the conversion valve casing and the air inlet 404 of the conversion valve body along the air inlet 201 of the ground brush, the air duct 203 of the ground brush and the air inlet pipe 505 of the motor chamber, and then enter the dust collecting barrel 301 by way of the airflow channel 406 of the conversion valve body, the air outlet 502 of the conversion valve pipe and the machine body inlet pipe 503 in turn. After being filtered through the filter 302, the air is finally discharged to atmosphere by way of the machine body air outlet duct 504, the motor vacuum chamber and the air exhaust pipe of the motor chamber in turn, while the dust and the finely divided sundries are remained in the dust collecting barrel 301. In this process, the airflow direction is shown as follows: air enters the air duct 203 of the ground brush from the air inlet 201 of the ground brush-->the air inlet pipe 505 of the motor chamber-->the conversion valve 400-->the machine body air inlet duct 503-->the dust collection chamber 300-->the machine body air outlet duct 504-->the motor vacuum chamber-->the air exhaust pipe of the motor chamber-->the air exhaust outlet-->atmosphere. FIGS. 7A and 7B substantially show this process.

Figure 8:
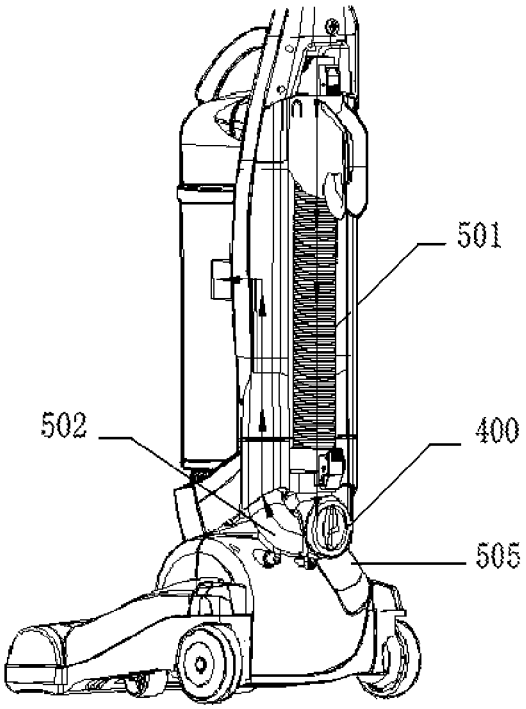
FIG. 8 is a diagram illustrating the airflow and the operating state of the conversion valve when the upright vacuum cleaner of the present invention cleans other positions.

When cleaning other positions on the ground such as hidden corners, steps and table tops by using the upright vacuum cleaner of the present invention, the user should firstly regulate the conversion valve knob 403 to the position as shown in FIG. 8, so that the second air inlet 411 (which is communicated with the suction soft pipe 501) of the conversion valve casing is aligned with the air inlet 404 of the conversion valve body, and thus the first air inlet 410 (which is communicated with the air inlet pipe of the motor chamber 505) of the conversion valve casing is also closed simultaneously. Then, the motor is powered on. Under the action of the suction force generated by the rotation of the fan driven by the motor, the dust or finely divided sundries adhering to the ground will, together with air, enter the conversion valve along the suction soft pipe 501. The subsequent processes are identical to those in the case of cleaning the ground, and the detailed description thereof is omitted.

As appreciated by those skilled in the art, although the embodiments of the present invention has been described hereinbefore, the present invention is not limited to those and various modifications of the present invention may be made. For example, the air outlet pipe 502 of the conversion valve and the machine body inlet pipe 503 can be designed as an integral pipe. For example, the air inlet pipe 505 of the motor chamber and the air duct 203 of the ground brush can also be designed as an integral pipe. In a word, any modification, equivalent substitution and improvement made without departing from the spirit and principle of the present invention shall fall within the protection scope of the present invention.

The invention claimed is:

1. An upright vacuum cleaner, comprising a cleaner body (100), a ground brush (200), a dust collection chamber (300), a conversion valve (400) and a pipeline system, the ground brush (200) is positioned at the lower part of the cleaner body (100) and is provided with an air inlet (201) of the ground brush and a motor chamber, the dust collection chamber (300) is positioned above the ground brush (200) and is provided with an air inlet (301) and an air outlet (302), the conversion valve (400) is provided with a first air inlet of the conversion valve, a second air inlet of the conversion valve and an air outlet of the conversion valve, the pipeline system comprises: a suction duct (501) connected with the second air inlet of the conversion valve; an air duct (203) of the ground brush connected with the air inlet (201) of the ground brush; an air outlet pipe (502) of the conversion valve connected with the air outlet of the conversion valve; a machine body air inlet duct (503) connecting the air outlet pipe (502) of the conversion valve with the air inlet (301) of the dust collection chamber; a machine body air outlet duct (504) connecting the air outlet (302) of the dust collection chamber with a motor chamber; and an exhaust pipe of the motor chamber, characterized in that, the pipeline system further comprises an air inlet pipe (505) of the motor chamber, of which air inlet pipe (505) one end is connected with the air duct (203) of the ground brush, and the other end is connected with the first air inlet of the conversion valve, and at least one part of the air inlet pipe of the motor chamber is provided within the motor chamber.

2. The upright vacuum cleaner of claim 1, characterized in that, the conversion valve is provided on the outside of the back surface of the cleaner body and is positioned in an inward recess between the dust collection chamber and the motor chamber.

3. The upright vacuum cleaner disclosed in claim 2, characterized in that, the conversion valve (400) comprises a conversion valve body (401), a conversion valve casing (402) and a conversion valve knob (403), the conversion valve body (401) is disposed within the conversion valve casing (402), and the conversion valve body (401) and the conversion valve casing (402) can slide with respect to each other in a rotary manner, an air inlet (404) of the conversion valve body and an air outlet (405) of the conversion valve body are provided on the conversion valve body (401), and an arc-shaped airflow channel (406) of the conversion valve body is provided between the air inlet (404) of the conversion valve body and the air outlet (405) of the conversion valve body, the conversion valve casing (402) comprises a conversion valve back casing (407) and a conversion valve front seat (408), an air outlet (409) of the conversion valve casing and a first air inlet (410) and a second air inlet (411) of the conversion valve casing are provided on the conversion valve back casing, the air outlet (409), the first air inlet (410) and the second air inlet (411) of the conversion valve casing are provided in a same plane and an angle between every two of them is 120 degrees, the air inlet (404) and the air outlet (405) of the conversion valve body and the air outlet (409), the first air inlet (410) and the second air inlet (411) of the conversion valve casing are also provided in a same plane, the first air inlet (410) of the conversion valve casing and the air inlet (404) of the conversion valve body jointly constitute the first air inlet of the conversion valve, the second air inlet (411) of the conversion valve casing and the air inlet (404) of the conversion valve body jointly constitute the second air inlet of the conversion valve, the air outlet (409) of the conversion valve casing and the air outlet (405) of the conversion valve body jointly constitute the air outlet of the conversion valve, and the conversion valve knob (403) comprises a torsion arm (413) and a rotating shaft (412) of which one end is connected with the conversion valve casing (402) and the other end is connected with the torsion arm (413).

4. The upright vacuum cleaner of claim 1, characterized in that, the end part of the suction duct (501) at the joint with the second air inlet (411, 404) of the conversion valve is designed as a hard pipe, and each of the air inlet pipe (505) of the motor chamber and the air outlet pipe (502) of the conversion valve is designed as a hard pipe.

5. The upright vacuum cleaner disclosed in claim 4, characterized in that, the conversion valve (400) comprises a conversion valve body (401), a conversion valve casing (402) and a conversion valve knob (403), the conversion valve body (401) is disposed within the conversion valve casing (402), and the conversion valve body (401) and the conversion valve casing (402) can slide with respect to each other in a rotary manner, an air inlet (404) of the conversion valve body and an air outlet (405) of the conversion valve body are provided on the conversion valve body (401), and an arc-shaped airflow channel (406) of the conversion valve body is provided between the air inlet (404) of the conversion valve body and the air outlet (405) of the conversion valve body, the conversion valve casing (402) comprises a conversion valve back casing (407) and a conversion valve front seat (408), an air outlet (409) of the conversion valve casing and a first air inlet (410) and a second air inlet (411) of the conversion valve casing are provided on the conversion valve back casing, the air outlet (409), the first air inlet (410) and the second air inlet (411) of the conversion valve casing are provided in a same plane and an angle between every two of them is 120 degrees, the air inlet (404) and the air outlet (405) of the conversion valve body and the air outlet (409), the first air inlet (410) and the second air inlet (411) of the conversion valve casing are also provided in a same plane, the first air inlet (410) of the conversion valve casing and the air inlet (404) of the conversion valve body jointly constitute the first air inlet of the conversion valve, the second air inlet (411) of the conversion valve casing and the air inlet (404) of the conversion valve body jointly constitute the second air inlet of the conversion valve, the air outlet (409) of the conversion valve casing and the air outlet (405) of the conversion valve body jointly constitute the air outlet of the conversion valve, and the conversion valve knob (403) comprises a torsion arm (413) and a rotating shaft (412) of which one end is connected with the conversion valve casing (402) and the other end is connected with the torsion arm (413).

6. The upright vacuum cleaner of claim 1, characterized in that, in the pipeline system, joints of all the pipes are designed in an arc shape.

7. The upright vacuum cleaner disclosed in claim 6, characterized in that, the conversion valve (400) comprises a conversion valve body (401), a conversion valve casing (402) and a conversion valve knob (403), the conversion valve body (401) is disposed within the conversion valve casing (402), and the conversion valve body (401) and the conversion valve casing (402) can slide with respect to each other in a rotary manner, an air inlet (404) of the conversion valve body and an air outlet (405) of the conversion valve body are provided on the conversion valve body (401), and an arc-shaped airflow channel (406) of the conversion valve body is provided between the air inlet (404) of the conversion valve body and the air outlet (405) of the conversion valve body, the conversion valve casing (402) comprises a conversion valve back casing (407) and a conversion valve front seat (408), an air outlet (409) of the conversion valve casing and a first air inlet (410) and a second air inlet (411) of the conversion valve casing are provided on the conversion valve back casing, the air outlet (409), the first air inlet (410) and the second air inlet (411) of the conversion valve casing are provided in a same plane and an angle between every two of them is 120 degrees, the air inlet (404) and the air outlet (405) of the conversion valve body and the air outlet (409), the first air inlet (410) and the second air inlet (411) of the conversion valve casing are also provided in a same plane, the first air inlet (410) of the conversion valve casing and the air inlet (404) of the conversion valve body jointly constitute the first air inlet of the conversion valve, the second air inlet (411) of the conversion valve casing and the air inlet (404) of the conversion valve body jointly constitute the second air inlet of the conversion valve, the air outlet (409) of the conversion valve casing and the air outlet (405) of the conversion valve body jointly constitute the air outlet of the conversion valve, and the conversion valve knob (403) comprises a torsion arm (413) and a rotating shaft (412) of which one end is connected with the conversion valve casing (402) and the other end is connected with the torsion arm (413).

8. The upright vacuum cleaner of claim 1, characterized in that, the air inlet pipe (505) of the motor chamber is a soft pipe.

9. The upright vacuum cleaner disclosed in claim 8, characterized in that, the conversion valve (400) comprises a conversion valve body (401), a conversion valve casing (402) and a conversion valve knob (403), the conversion valve body (401) is disposed within the conversion valve casing (402), and the conversion valve body (401) and the conversion valve casing (402) can slide with respect to each other in a rotary manner, an air inlet (404) of the conversion valve body and an air outlet (405) of the conversion valve body are provided on the conversion valve body (401), and an arc-shaped airflow channel (406) of the conversion valve body is provided between the air inlet (404) of the conversion valve body and the air outlet (405) of the conversion valve body, the conversion valve casing (402) comprises a conversion valve back casing (407) and a conversion valve front seat (408), an air outlet (409) of the conversion valve casing and a first air inlet (410) and a second air inlet (411) of the conversion valve casing are provided on the conversion valve back casing, the air outlet (409), the first air inlet (410) and the second air inlet (411) of the conversion valve casing are provided in a same plane and an angle between every two of them is 120 degrees, the air inlet (404) and the air outlet (405) of the conversion valve body and the air outlet (409), the first air inlet (410) and the second air inlet (411) of the conversion valve casing are also provided in a same plane, the first air inlet (410) of the conversion valve casing and the air inlet (404) of the conversion valve body jointly constitute the first air inlet of the conversion valve, the second air inlet (411) of the conversion valve casing and the air inlet (404) of the conversion valve body jointly constitute the second air inlet of the conversion valve, the air outlet (409) of the conversion valve casing and the air outlet (405) of the conversion valve body jointly constitute the air outlet of the conversion valve, and the conversion valve knob (403) comprises a torsion arm (413) and a rotating shaft (412) of which one end is connected with the conversion valve casing (402) and the other end is connected with the torsion arm (413).

10. The upright vacuum cleaner of claim 1, characterized in that, the air inlet pipe (505) of the motor chamber is composed of three parts communicated in turn.

11. The upright vacuum cleaner of claim 10, characterized in that, among the three parts constituting the air inlet pipe (505) of the motor chamber, the part that is directly communicated with the first air inlet of the conversion valve is a soft pipe, and the other two parts are hard pipes.

12. The upright vacuum cleaner disclosed in claim 11, characterized in that, the conversion valve (400) comprises a conversion valve body (401), a conversion valve casing (402) and a conversion valve knob (403), the conversion valve body (401) is disposed within the conversion valve casing (402), and the conversion valve body (401) and the conversion valve casing (402) can slide with respect to each other in a rotary manner, an air inlet (404) of the conversion valve body and an air outlet (405) of the conversion valve body are provided on the conversion valve body (401), and an arc-shaped airflow channel (406) of the conversion valve body is provided between the air inlet (404) of the conversion valve body and the air outlet (405) of the conversion valve body, the conversion valve casing (402) comprises a conversion valve back casing (407) and a conversion valve front seat (408), an air outlet (409) of the conversion valve casing and a first air inlet (410) and a second air inlet (411) of the conversion valve casing are provided on the conversion valve back casing, the air outlet (409), the first air inlet (410) and the second air inlet (411) of the conversion valve casing are provided in a same plane and an angle between every two of them is 120 degrees, the air inlet (404) and the air outlet (405) of the conversion valve body and the air outlet (409), the first air inlet (410) and the second air inlet (411) of the conversion valve casing are also provided in a same plane, the first air inlet (410) of the conversion valve casing and the air inlet (404) of the conversion valve body jointly constitute the first air inlet of the conversion valve, the second air inlet (411) of the conversion valve casing and the air inlet (404) of the conversion valve body jointly constitute the second air inlet of the conversion valve, the air outlet (409) of the conversion valve casing and the air outlet (405) of the conversion valve body jointly constitute the air outlet of the conversion valve, and the conversion valve knob (403) comprises a torsion arm (413) and a rotating shaft (412) of which one end is connected with the conversion valve casing (402) and the other end is connected with the torsion arm (413).

13. The upright vacuum cleaner disclosed in claim 10, characterized in that, the conversion valve (400) comprises a conversion valve body (401), a conversion valve casing (402) and a conversion valve knob (403), the conversion valve body (401) is disposed within the conversion valve casing (402), and the conversion valve body (401) and the conversion valve casing (402) can slide with respect to each other in a rotary manner, an air inlet (404) of the conversion valve body and an air outlet (405) of the conversion valve body are provided on the conversion valve body (401), and an arc-shaped airflow channel (406) of the conversion valve body is provided between the air inlet (404) of the conversion valve body and the air outlet (405) of the conversion valve body, the conversion valve casing (402) comprises a conversion valve back casing (407) and a conversion valve front seat (408), an air outlet (409) of the conversion valve casing and a first air inlet (410) and a second air inlet (411) of the conversion valve casing are provided on the conversion valve back casing, the air outlet (409), the first air inlet (410) and the second air inlet (411) of the conversion valve casing are provided in a same plane and an angle between every two of them is 120 degrees, the air inlet (404) and the air outlet (405) of the conversion valve body and the air outlet (409), the first air inlet (410) and the second air inlet (411) of the conversion valve casing are also provided in a same plane, the first air inlet (410) of the conversion valve casing and the air inlet (404) of the conversion valve body jointly constitute the first air inlet of the conversion valve, the second air inlet (411) of the conversion valve casing and the air inlet (404) of the conversion valve body jointly constitute the second air inlet of the conversion valve, the air outlet (409) of the conversion valve casing and the air outlet (405) of the conversion valve body jointly constitute the air outlet of the conversion valve, and the conversion valve knob (403) comprises a torsion arm (413) and a rotating shaft (412) of which one end is connected with the conversion valve casing (402) and the other end is connected with the torsion arm (413).

14. The upright vacuum cleaner disclosed in claim 1, characterized in that, the conversion valve (400) comprises a conversion valve body (401), a conversion valve casing (402) and a conversion valve knob (403), the conversion valve body (401) is disposed within the conversion valve casing (402), and the conversion valve body (401) and the conversion valve casing (402) can slide with respect to each other in a rotary manner, an air inlet (404) of the conversion valve body and an air outlet (405) of the conversion valve body are provided on the conversion valve body (401), and an arc-shaped airflow channel (406) of the conversion valve body is provided between the air inlet (404) of the conversion valve body and the air outlet (405) of the conversion valve body, the conversion valve casing (402) comprises a conversion valve back casing (407) and a conversion valve front seat (408), an air outlet (409) of the conversion valve casing and a first air inlet (410) and a second air inlet (411) of the conversion valve casing are provided on the conversion valve back casing, the air outlet (409), the first air inlet (410) and the second air inlet (411) of the conversion valve casing are provided in a same plane and an angle between every two of them is 120 degrees, the air inlet (404) and the air outlet (405) of the conversion valve body and the air outlet (409), the first air inlet (410) and the second air inlet (411) of the conversion valve casing are also provided in a same plane, the first air inlet (410) of the conversion valve casing and the air inlet (404) of the conversion valve body jointly constitute the first air inlet of the conversion valve, the second air inlet (411) of the conversion valve casing and the air inlet (404) of the conversion valve body jointly constitute the second air inlet of the conversion valve, the air outlet (409) of the conversion valve casing and the air outlet (405) of the conversion valve body jointly constitute the air outlet of the conversion valve, and the conversion valve knob (403) comprises a torsion arm (413) and a rotating shaft (412) of which one end is connected with the conversion valve casing (402) and the other end is connected with the torsion arm (413).

* * * * *